United States Patent [19]

Paoletti et al.

[11] 4,234,312

[45] Nov. 18, 1980

[54] PROCESS AND DEVICE FOR THE CONTINUOUS SPINNING OF VISCOSE RAYON

[75] Inventors: Ugo Paoletti, Monza; Alessandro Volterra, Milan, both of Italy

[73] Assignee: Societa' Nazionale Industria Applicazioni Viscosa S.p.A., Milan, Italy

[21] Appl. No.: 950,611

[22] Filed: Oct. 12, 1978

[30] Foreign Application Priority Data

Oct. 25, 1977 [IT] Italy ..... 28923 A/77

[51] Int. Cl.[3] ..... D06B 1/00

[52] U.S. Cl. ..... 8/151.2; 34/154; 68/20; 264/198

[58] Field of Search ..... 264/188, 233, 198; 28/246; 239/596; 425/73-75, 68; 8/151.2, 152; 68/20; 34/154

[56] References Cited

U.S. PATENT DOCUMENTS

| | | | |
|---|---|---|---|
| 1,153,004 | 9/1915 | Althouse | 8/115.2 |
| 2,041,338 | 5/1936 | Harrison | 8/115.2 |
| 2,177,323 | 10/1939 | Kirkendall | 8/115.2 |
| 3,515,780 | 6/1970 | O'Connell et al. | 264/188 |
| 3,730,679 | 5/1973 | Schuierer | 8/152 |
| 3,910,320 | 10/1975 | Finley et al. | 28/246 |
| 3,924,984 | 12/1975 | Giacobazzi | 425/68 |
| 4,076,499 | 2/1978 | Mogilevsky | 8/115.2 |

FOREIGN PATENT DOCUMENTS

| | | | |
|---|---|---|---|
| 638929 | 4/1962 | Italy | 264/188 |
| 753235 | 7/1956 | United Kingdom | 8/151.2 |
| 762959 | 12/1956 | United Kingdom | 8/151.2 |

*Primary Examiner*—Jay H. Woo

*Attorney, Agent, or Firm*—Wenderoth, Lind & Ponack

[57] ABSTRACT

The removal of water from viscose rayon yarns in the continuous spinning of such yarns is improved by subjecting the yarns to the action of an air jet before the thermal drying treatment. The air jet impinges on the yarns adjacent their passage from the last liquid treatment zone to the drying zone and is directed approximately tangentially to the treatment roller, that is to the helicoidal path of the yarn. The removal of the water is completed by thermal drying. Up to 50% of the water content, and several times the dry weight of the yarn, is eliminated by the pneumatic treatment. The air jet is directed on the yarn by means of a slit-shaped nozzle having its larger dimension substantially parallel to the treatment roller. A plurality of yarns can be treated concurrently on the same device having a plurality of guide rollers.

8 Claims, 4 Drawing Figures

Fig. 1
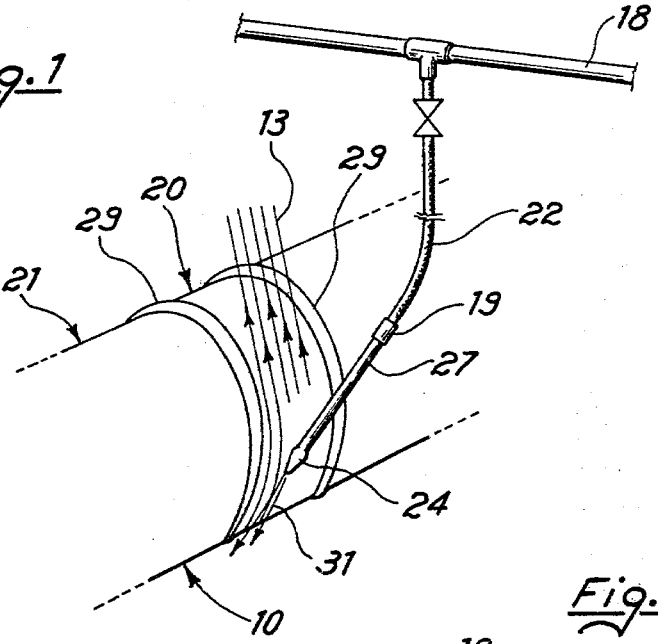
Fig. 2
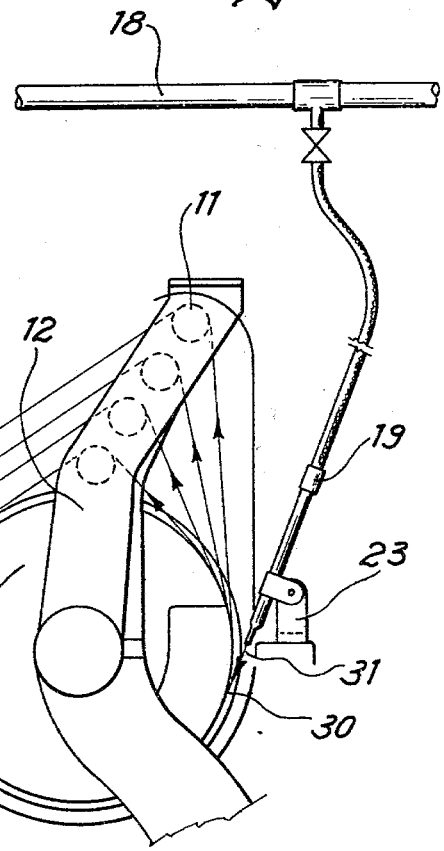
Fig. 4
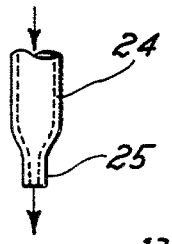
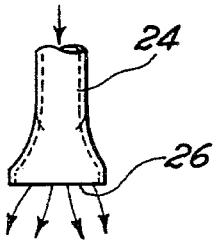
Fig. 3

PROCESS AND DEVICE FOR THE CONTINUOUS SPINNING OF VISCOSE RAYON

BACKGROUND OF THE INVENTION (a) The Field of the Invention

The present invention relates to an improvement in processes and devices for the continuous spinning of viscose rayon.

(b) The Prior Art

Processes of this kind are known wherein the viscous spinning dope is extruded through suitable spinnerets and coagulated to form filaments which are grouped into multifilament yarns, and stretched, in suitable coagulating and drawing baths, comprising or not comprising guide tubes wherein the yarn travels in equicurrent with respect to the bath, and from which the yarn proceeds to travel in a substantially helicoidal path, that is a path constituted by a series of coils which generally are not helical but are close to helical form. Practically this is effected by passing the yarn over a main or treatment roller having a relatively large diameter, on which the chemical and thermal treatments of the yarn take place, and on an advancement roller having a much smaller diameter than the first one and being askew with respect thereto. Spinning machines of this kind are described and illustrated e.g. in Italian Pat. No. 638,929. It is possible to process a plurality of yarns concurrently, and this is normally done, by passing a plurality of yarns originating from as many spinnerets, over a single treatment roller and over a plurality of advancing rollers, each of these latter corresponding to one yarn. In describing this invention only one advancing roller and therefore the treatment of one yarn will be illustrated, but it should be kept in mind that there will be in practice a plurality of yarns and a corresponding plurality of advancing rollers. The yarn undergoes in its helicoidal travel a succession of treatments generally comprising setting, desulphuration, bleaching, finishing, and the corresponding washings, and may undergo particular coagulating and setting treatments which are not a part of the invention.

In all cases the yarn must be dried at the end of the aforesaid treatments. This is effected by passing the yarn over a zone of the treatment roller which is conveniently heated.

SUMMARY OF THE INVENTION

The present invention particularly concerns an improvement in the phase of the elimination of the water from the yarn. The invention is characterized in that a part of the water is eliminated by pneumatic action from the yarn before it is thermally dried, by directing a blade of air onto a certain number of coils in the zone immediately preceding the thermal drying zone.

Normally such preceding zone is a finishing zone and therefore the coils on which the blade of air acts are situated in the passage of the yarn from the finishing zone to the drying zone.

According to the invention the blade of air is directed in a direction approximately tangential to the treatment roller and is applied to the yarn in the zone in which it is in contact with the treatment roller. It has been found that this position has great importance from various viewpoints. On the one hand, it has been noticed that it prevents the entanglement of the filaments which could derive from a pneumatic treatment in a zone in which the yarn were free to vibrate. On the other hand, it assists the water eliminated from the yarn in flowing off and being collected.

Contrary to what could have been thought, the effect of the pneumatic treatment is at least as great as it would have been if the yarn were free, in spite of the fact that the yarn lies on the treatment roller, a fact which should have limited, according to logical expectations, the efficacy of the pneumatic treatment.

The air employed may be hot or even cold, since the effect of the treatment is essentially mechanical. It has been found that in this way a very considerable portion of the water contained in the yarn is eliminated, generally an amount equal to several times the dry weight of the yarn and preferably close to 50% of the water which was originally present, up to 50%, so that the thermal drying is facilitated and can take place in a shorter time, the temperature being the same. This makes it possible to advance the yarn at a higher speed without changing the length of the drying zone, or to reduce the length of the drying zone if the speed is unchanged.

BRIEF DESCRIPTION OF THE DRAWINGS

The invention will be better understood from the following detailed description of an embodiment thereof, with reference to the appended drawings wherein:

FIG. 1 represents in perspective view the zone of the treatment roller in which the application of air to the yarn takes place, according to an embodiment of the invention, all the remaining parts of the roller being substantially omitted and the askew advancing rollers which cooperate therewith to guide the yarns being omitted, only one of the yarns being illustrated;

FIG. 2 is an end view of a device for the continuous spinning of viscose rayon, seen from the part at which the yarns leave the device after the drying, such device being equipped for the concurrent processing of four yarns; and FIGS. 3 and 4 are two lateral views, at 90° to each other, of a nozzle for applying air to the yarn.

DETAILED DESCRIPTION OF THE INVENTION

With reference to the drawings, numeral 10 generally indicates a treatment roller of which only the end portion is shown, as has been said. Numeral 11 represents a plurality of advancing or guide rollers askew with respect to roller 10, on each of which a yarn travels.

In the example illustrated, there are four rollers and also four yarns. Numeral 12 indicates supports for the advancing rollers and numeral 13 indicates the yarn which advance on the rollers in the directions indicated by the arrows, leaving the device at the end of the treatment (see FIG. 2).

Numeral 20 generally indicates the last liquid treatment zone, which generally is a finish application zone, and numeral 21 indicates the drying zone in which the yarn is dried by heating it with means not illustrated. A blower device is mounted in correspondence with the zone 20, and more precisely with the end coils of such zone, such device comprising a pipeline 22 which is illustrated as broken off, and to which air is fed through a valve from a feed pipeline indicated at 18. Any suitable support device, schematically indicated at 19, supports a blower element 27 which ends in a nozzle 24 and receives air from pipeline 22.

The nozzle, better illustrated in FIGS. 3 and 4, is flattened at its end 25, whereby it has an orifice having the shape of a rectangular slit indicated at 26, with the longer side placed with an orientation substantially parallel to the axis of roller 10. The last coils of yarn 13 are engaged by the air jet which issues from orifice 26 of the nozzle and which is directed substantially tangentially to the roller 10, striking the roller at zone 30 which corresponds approximately to the point at which the yarns 13 leave roller 10, such correspondence being approximate since the yarns leave the roller at different points from one another. The dynamic effect of the air jet produces the elimination of liquid from the filaments and such liquid is collected in any suitable collecting trough schematically indicated at 32 in FIG. 2. At this point the yarns, which have been freed from a substantial amount of water, pass to the drying zone 21 over the flanges or double flanges 29 which separate the zones of roller 10 from one another, and when completely dried are wound up.

An embodiment of the invention, relative to a specific spinning operation, will now be described for purposes of illustration.

Viscose rayon yarns (regenerated cellulose) having a count of 120 den each, have been spun. An apparatus of the kind described above processed four such yarns, one per guide roller.

The spinning speed was 110 m/min and the production was 0.352 kg/hour.

From nozzle 24 an air jet 31 issued at a flow rate 3.5 $m^3$/hour and a nozzle speed of 138 m/sec. The dimensions of the nozzle were such that the blade-shaped jet of air issuing therefrom engaged two coils of each yarn.

Under such conditions, the water content carried by the yarn, which originally was eight times the dry weight of the yarn, was reduced to four times such weight. The steam consumption was thus reduced by 50% and it has been further possible to adopt a length of the drying zone equal to that which was necessary, prior to the invention, to spin with a much smaller spinning speed.

We claim:

1. In a process for the continuous spinning of viscose rayon yarns, wherein each of a plurality of yarns is caused to travel as coils in a substantially helicoidal path, partly over a treatment roller and a respective advancing roller, while being subjected to a plurality of liquid treatment operations followed by a drying treatment, the improvement of eliminating a portion of the liquid carried by said yarns from said liquid treatment operation before passage to said drying treatment, said improvement comprising:

directing a blade-shaped jet of air having a maximum dimension extending in a direction parallel to the axis of said treatment roller against at least one coil of each of said yarns, at a position thereof in contact with said treatment roller, and against said treatment roller, said jet of air being directed in a direction substantially tangential to said treatment roller and to said substantially helicoidal paths of said yarns at said position, and said jet of air contacting said yarn coils and said treatment roller at a location immediately preceding said drying treatment.

2. The improvement claimed in claim 1, wherein said jet of air is directed in a generally downward direction.

3. The improvement claimed in claim 1, wherein said operation of eliminating comprises removing from said yarns an amount of said liquid equal to several times the dry weight of said yarn, and wherein said drying treatment comprises removing remaining said liquid from said yarns by a thermal drying operation.

4. In an apparatus for the continuous spinning of viscose rayon yarns, said apparatus being of the type including a treatment roller divided into plural treatment zones, including at least one liquid treatment zone and a final drying zone, and a plurality of advancing rollers spaced from and positioned askew with respect to said treatment roller, each of a plurality of yarns being caused to travel as coils in a substantially helicoidal path over said treatment roller and over a respective said advancing roller, whereby said yarns are subjected to a liquid treatment operation in said liquid treatment zone followed by a drying treatment in said drying zone, the improvement of means for eliminating a portion of the liquid carried by said yarns from said liquid treatment zone before passage to said drying zone, said eliminating means comprising:

an air nozzle positioned in the vicinity of said liquid treatment zone immediately preceding said drying zone, said nozzle being spaced from said treatment roller and from said yarns traveling thereover, said nozzle having therein an elongated orifice having a maximum dimension extending in a direction parallel to the axis of said treatment roller, and said nozzle and said orifice having an axis directed substantially tangentially of the surface of said treatment roller; and means for feeding compressed air into said nozzle and through said orifice, and for thereby directing a blade-shaped jet of air tangentially onto said liquid treatment zone immediately preceding said drying zone and onto at least one coil of each of said yarns traveling thereover.

5. The improvement claimed in claim 4, wherein said nozzle is positioned to direct said blade-shaped jet of air onto the last of said coils of said yarns immediately before passage thereof to said drying zone.

6. The improvement claimed in claim 4, wherein said nozzle is positioned to direct said blade-shaped jet of air onto said yarns at the position whereat said yarns leave contact with said treatment roller during travel to respective said advancing rollers.

7. The improvement claimed in claim 6, wherein said nozzle is positioned to direct said blade-shaped jet of air against said yarns approximately tangentially of said helicoidal path thereof.

8. The improvement claimed in claim 4, wherein said nozzle is positioned to direct said jet of air in a generally downward direction.

* * * * *

UNITED STATES PATENT AND TRADEMARK OFFICE

CERTIFICATE OF CORRECTION

PATENT NO. : 4,234,312
DATED : November 18, 1980
INVENTOR(S) : Ugo Paoletti et al.

It is certified that error appears in the above—identified patent and that said Letters Patent is hereby corrected as shown below:

On the title page,

In Section "[73]", correct the Assignee's name as follows:

--SNIA VISCOSA SOCIETA' NAZIONALE INDUSTRIA APPLICAZIONI VISCOSA S.p.A.--

Signed and Sealed this

*Second* Day of *June 1981*

[SEAL]

*Attest:*

RENE D. TEGTMEYER

*Attesting Officer*

*Acting Commissioner of Patents and Trademarks*